United States Patent [19]

Wenzel et al.

[11] 4,234,136

[45] Nov. 18, 1980

[54] APPARATUS FOR THE REPLACEABLE MOUNTING OF A WINDING DRUM FOR WEB-LIKE MATERIAL

[75] Inventors: Hubert Wenzel, Seelze; Reinhard Mössinger, Neustadt, both of Fed. Rep. of Germany

[73] Assignee: Continental Gummi-Werke Aktiengesellschaft, Hanover, Fed. Rep. of Germany

[21] Appl. No.: 39,876

[22] Filed: May 17, 1979

[30] Foreign Application Priority Data

Apr. 26, 1978 [DE] Fed. Rep. of Germany ..... 2818188

[51] Int. Cl.[3] ..... B65H 17/02

[52] U.S. Cl. ..... 242/68.4

[58] Field of Search ..... 242/68, 68.4, 129.53, 242/129.51, 129.6, 130

[56] References Cited

U.S. PATENT DOCUMENTS

| | | | |
|---|---|---|---|
| 631,402 | 8/1899 | Lewis | 242/68 |
| 725,426 | 4/1903 | Eccleston | 242/68 |
| 2,896,871 | 7/1959 | Woodruff | 242/68.4 X |

FOREIGN PATENT DOCUMENTS

| | | | |
|---|---|---|---|
| 513629 | 2/1958 | Italy | 242/68.4 |

*Primary Examiner*—Edward J. McCarthy

*Attorney, Agent, or Firm*—Becker & Becker, Inc.

[57] ABSTRACT

Apparatus for the replaceable mounting of a winding drum for web-like material. The apparatus includes two supporting carriers which rotatably hold the winding drum at both end faces. The carriers are pivotally mounted about substantially horizontal axes.

7 Claims, 3 Drawing Figures

APPARATUS FOR THE REPLACEABLE MOUNTING OF A WINDING DRUM FOR WEB-LIKE MATERIAL

The present invention relates to an apparatus for the replaceable mounting of a winding drum for web-like material, and has two supporting carriers which rotatably hold the winding drum at both end faces.

Flexible sheets or webs of goods, such as printing paper, textile webs, rubber or plastics material sheets, thin metal sheets, and the like are generally supplied for processing, in the form of rolls wound on sleeves or bored rigid cores, so that by inserting a spindle or, alternatively, by sliding onto a winding shaft provided therefor, the drums can be inserted into a machine or an individual unwinding device and can be retained, rotatably mounted, for winding and unwinding of the goods. Removal and replacement of the comparatively bulky, unwieldy, winding axles necessary with each replacement of the winding drums is a time and effort-consuming operation which, even with the use of auxiliary force actuated devices, such as pressure medium working cylinders or power driven rotated threaded spindles, too frequently forces undesired interruptions in operation and is contrary to all economical efforts. Since the shafts or spindles must always be considerably longer than the winding drums themselves, and can only be axially displaced within the narrow bore of the core, the space requirement which has to be allowed for in lateral extension of the winding devices is also extremely important. These drawbacks may be partially compensated for by the introduction of axially displaceable journals extending from both sides of the winding drums in place of a continuous shaft. In practice, however, particularly in the case of winding operations occurring in rapidly changing succession, the apparatus used still requires further simplification.

It is therefore an object of the present invention to provide an automatically controlled drum change to be effected without the need of individual driving devices and auxiliary force actuated devices, and without the necessity of manual actions.

Figure 1:
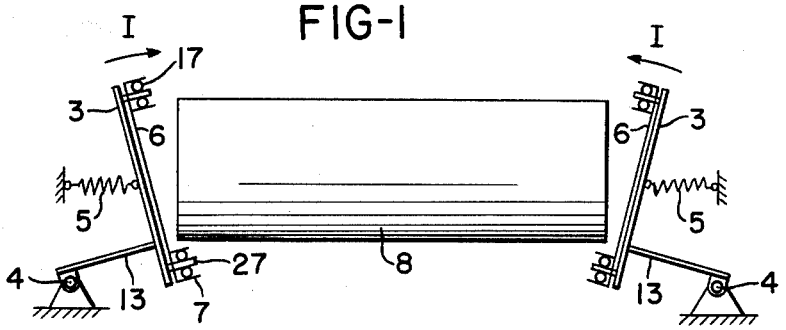
Figure 2:
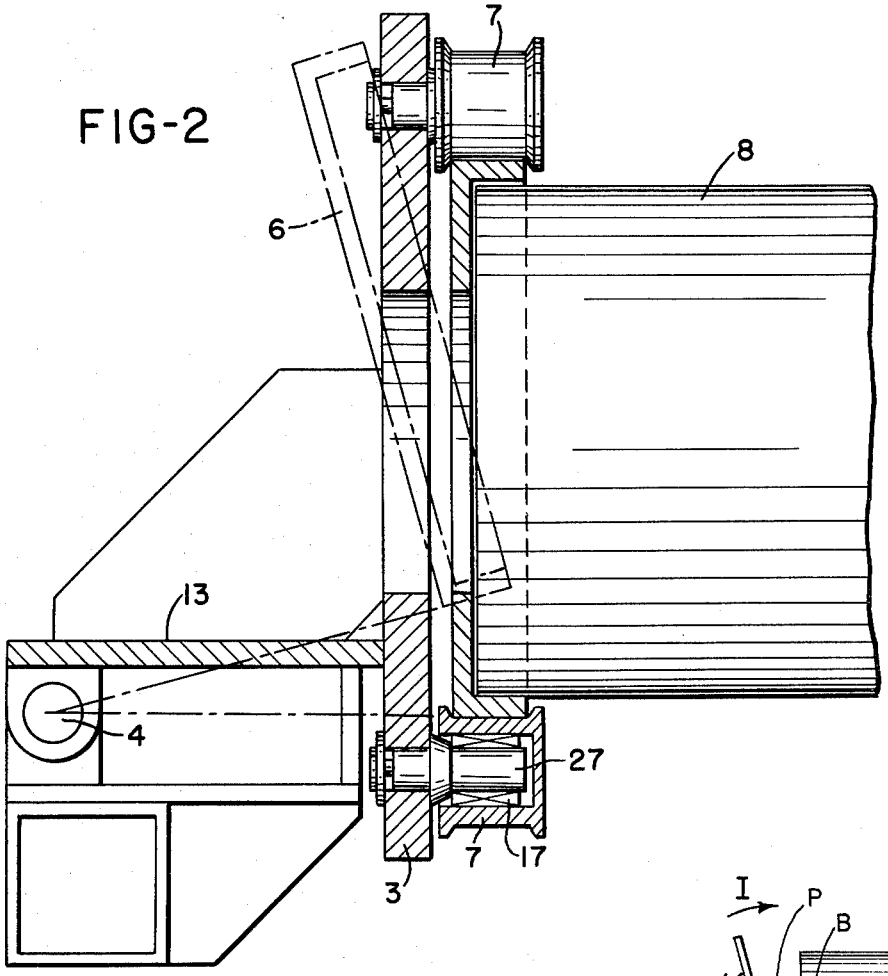

This object, and other objects and advantages of the present invention, will appear more clearly from the following specification in connection with the accompanying drawing, in which:

FIG. 1 schematically illustrates the arrangement and functioning according to the present invention; and FIG. 2 shows in detail and on an enlarged scale a portion of FIG. 1.

Figure 3:
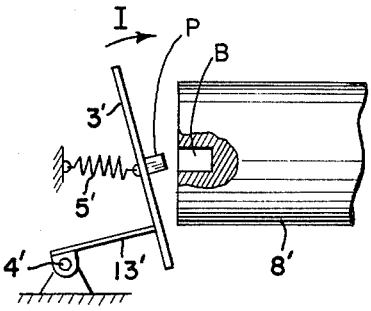

FIG. 3 is a partially sectioned fragmentary view showing journal engagement capability in a central bore of a winding drum in a modification of illustrations of FIGS. 1 and 2.

According to the present invention, the apparatus of the above mentioned general type is characterized primarily in that the carriers are pivotally mounted about substantially horizontal axes.

Preferably, the pivot axes of the carriers are axially spaced from the end faces of the winding drum, and are located in a plane tangential to the lower circumferential arc of the drum.

Pursuant to another embodiment of the present invention, the carriers are loaded or biased with a return force acting constantly in the direction towards a rest position at an acute angle to the end faces of the winding drum and out of connection therewith, the force being less than the dead weight of the winding drum. This return force may, for example, be provided by springs having a collectively lower tensional force than the drum weight.

On the one hand, the invention leads to a surprisingly simple structure of the winding apparatus, yet on the other hand makes possible replacement of the winding drum in a considerably accelerated manner relative to known apparatus and without the aid of mechanical or powered additional devices. The pivotal movement of the carriers, normally retained in their rest position by the action of the return springs, is initiated completely automatically as soon as the winding drum to be inserted is lowered into the apparatus and, with the lower edge of the two end faces thereof, contacts the still inclined carriers. In the further course of the lowering movement, the drum engages the two carriers against the tension of the return springs until, in the upright positon of use of the carrier, the rotary movement has been produced and the drum is supported at both ends. In the same manner, the emptied drum can be readily removed, whereby the carriers automatically swivel up and cease the rotary movement. The pivotal mounting of the two carriers occupies relatively little space at both ends of the apparatus.

To receive the winding drum and produce the rotary connection therewith, the carriers may engage in the position of use in the central bore of the drum or may be provided with journals enclosing the winding core. Pursuant to a preferred alternative embodiment of the invention, the carriers may also be provided with sleeves, bushings or similar cylindrical hollow bodies mounted freely rotatable on the carriers, which, in the position of use, enclose the end faces of the winding drum. This type of drum reception has the advantage of not being dependent upon the nature of the drum core or the existence of an axial bore, and therefore permits universal deployment of the novel apparatus for any type of material roll.

It is within the scope of the invention to couple insertion or removal of the winding core with starting or braking devices of a driving motor, or, also to operatively connect these operations with automatic locking systems for the pivot bearings.

Referring now to the drawing in detail, the main component of the apparatus comprises two supporting carriers 3, both of which are pivotal about a fixed horizontal journal 4 by means of brackets 13, respectively mounted in the lower region of the carriers and having pivot bearings. Each carrier 3 is subjected to the action of a tension spring 5, which abuts against a fixed part of the apparatus. Each spring constantly tends to pivot its associated carrier 3 into its rest position as shown in FIG. 1. Located on the end faces of the carriers 3, which end faces are turned towards one another, are receiving sleeves 6 which, with the aid of several roller bodies 7 distributed over their circumference, are rotatably but axially non-displaceably connected to the carriers 3. In accordance with the detail drawing in FIG. 2, the roller bodies 7 are designed as rotary rollers which, in a form locking manner, enclose the receiving sleeves 6 and in turn are mounted on pins 27 inserted in the carriers 3 with the interposition of roller bearings 17.

The tension of the springs 5 is such that on the whole it is overcome by the dead weight of the winding drum even in its empty state. Proceeding from the arrangement of FIG. 1, on insertion of a winding drum 8, the lower peripheral arc of the latter will at first stop against the inner edges of the receiving sleeves 6, which are still in the rest position. During the further course of the lowering movement of the drum, it will swivel the sleeves 6 upwards into the upright position of use shown in full lines in FIG. 2, and in the direction of the arrows I shown in FIG. 1, against the tension of the springs 5. This completes the insertion operation, and the unwinding of the fabric web may be initiated immediately thereafter.

To replace an empty drum 8, the latter need only be lifted out of the apparatus, whereby simultaneously also the carriers 3, subject to the action of the tension springs 5, may be swivelled back into their rest positions, freeing the receiving sleeves 6 for insertion of a replacement drum.

FIG. 3 shows in a fragmentary sectioned view components similar to those of FIGS. 1 and 2 with primes added to reference numerals of comparable parts as well as showing a projection P for journalling engagement in a central bore B of the winding drum.

The present invention is, of course, in no way restricted to the specific disclosure of the specification and drawings, but also encompasses any modifications within the scope of the appended claims.

What we claim is:

1. An apparatus for the replaceable mounting of a winding drum for web-like material, said winding drum having two end faces, said apparatus comprising in combination two supporting carriers for rotatably holding said winding drum at both of said end faces, said carriers being respectively pivotally mounted in said apparatus about substantially horizontal axes, and means normally retaining said carriers in rest position subject to pivotal movement of said carriers being initiated completely automatically as soon as said winding drum to be inserted is lowered into the apparatus until said drum is supported at both end faces whereas an emptied drum can be readily removed whereby said carriers automatically swivel up and cease the rotary movement.

2. An apparatus for the replaceable mounting of a winding drum for web-like material, said winding drum having two end faces, said apparatus comprising two supporting carriers for rotatably holding said winding drum at both of said end faces, said carriers being respectively pivotally mounted in said apparatus about substantially horizontal axes, said pivotal axes of said carriers being axially spaced from said end faces of said winding drum and lying in a plane which is substantially tangential to the lower circumferential arc of said winding drum when the latter is rotatably held by said carriers.

3. An apparatus according to claim 2, which includes means for loading said carriers with a return force constantly acting in a direction away from the pertaining end faces of said winding drum towards a rest position at an acute angle to said end faces of said winding drum and acting out of connection therewith, said force being less than the dead weight of said winding drum.

4. An apparatus according to claim 3, in which said means for loading said carriers with a return force comprises springs having a tensional force smaller, collectively, than the dead weight of said winding drum.

5. An apparatus according to claim 2, in which said carriers are respectively provided with journals engaging, in their position of use, in the central bore of a winding drum.

6. An apparatus for the replaceable mounting of a winding drum for web-like material, said winding drum having two end faces, said apparatus comprising two supporting carriers for rotatably holding said winding drum at both of said end faces, said carriers being respectively pivotally mounted in said apparatus about substantially horizontal axes, said carriers being respectively provided with sleeves enclosing, in their position of use, said end faces of said winding drum.

7. An apparatus according to claim 6, in which said sleeves are freely rotatably mounted on the pertaining carrier.

* * * * *